US008826902B2

(12) United States Patent
Schwendimann et al.

(10) Patent No.: US 8,826,902 B2
(45) **Date of Patent: *Sep. 9, 2014**

(54) IMAGE TRANSFER SHEET

(71) Applicant: Jodi A. Schwendimann, Plymouth, MN (US)

(72) Inventors: Jodi A. Schwendimann, Minnetonka Beach, MN (US); Nabil F. Nasser, Dayton, OH (US)

(73) Assignee: Jodi A. Schwendimann, Plymouth, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/893,748

(22) Filed: May 14, 2013

(65) Prior Publication Data

US 2013/0248094 A1 Sep. 26, 2013

Related U.S. Application Data

(63) Continuation of application No. 13/447,886, filed on Apr. 16, 2012, now Pat. No. 8,541,071, which is a continuation of application No. 12/955,512, filed on Nov. 29, 2010, now Pat. No. 8,197,918, which is a continuation of application No. 11/054,717, filed on Feb. 9, 2005, now Pat. No. Re. 42,541, which is an application for the reissue of Pat. No. 6,551,692.

(51) Int. Cl.
*B41M 5/382* (2006.01)
*B44C 1/17* (2006.01)

(52) U.S. Cl.
CPC ..... *B44C 1/172* (2013.01); *B41M 5/38257* (2013.01)
USPC ..... 126/235; 428/32.51; 428/32.81; 428/32.87

(58) Field of Classification Search
CPC ..... B41M 5/38257; B41M 2205/06; B41M 2205/10; B44C 1/172
USPC ..... 503/227; 156/235; 428/32.51, 32.81, 428/32.87
See application file for complete search history.

(56) References Cited

U.S. PATENT DOCUMENTS 3,790,439 A 2/1974 La Perre et al.
3,922,435 A 11/1975 Asnes (Continued)

FOREIGN PATENT DOCUMENTS

EP 0466503 A1 1/1992
EP 0782931 A1 7/1997

(Continued)

OTHER PUBLICATIONS

"U.S. Appl. No. 09/150,983, Final Office Action mailed Aug. 2, 2000", 9 pgs.

(Continued)

*Primary Examiner* — Bruce H Hess
(74) *Attorney, Agent, or Firm* — Schwegman, Lundberg & Woessner, P.A.

(57) ABSTRACT

The present invention includes an article and method for transferring an image from one substrate to another. The method includes providing or obtaining an image transfer sheet that is comprised of a substrate layer, a release layer and an image-imparting layer that may comprise a low density polyethylene or other polymeric component having a melting temperature within a range of about 90 degrees C. to about 700 degrees C. An image is imparted to the low density polyethylene area with an image-imparting medium. A second image-receiving substrate can be provided. The second image-receiving substrate is contacted to the first image transfer sheet at the polymer, image-imparting layer. Heat is applied to the image transfer sheet so that the low density polyethylene encapsulates the image-imparting medium and transfers the encapsulates to the image-receiving substrate, thereby forming a mirror image on the image-receiving substrate.

20 Claims, 1 Drawing Sheet

(56) References Cited

U.S. PATENT DOCUMENTS 4,102,456 A 7/1978 Morris
4,169,169 A 9/1979 Kitabatake
4,224,358 A 9/1980 Hare
4,235,657 A 11/1980 Greenman et al.
4,284,456 A 8/1981 Hare
4,399,209 A 8/1983 Sanders et al.
4,461,793 A 7/1984 Blok et al.
4,548,857 A 10/1985 Galante
4,549,824 A 10/1985 Sachdev et al.
4,594,276 A 6/1986 Relyea
4,685,984 A 8/1987 Powers et al.
4,758,952 A 7/1988 Harris, Jr. et al.
4,863,781 A 9/1989 Kronzer
4,880,678 A 11/1989 Goffi
4,966,815 A 10/1990 Hare
4,980,224 A 12/1990 Hare
5,019,475 A 5/1991 Higashiyama et al.
5,028,028 A 7/1991 Yamada et al.
5,045,383 A 9/1991 Maeda et al.
5,059,580 A 10/1991 Shibata et al.
5,097,861 A 3/1992 Hopkins et al.
5,110,389 A 5/1992 Hiyoshi et al.
5,133,819 A 7/1992 Croner
5,139,917 A 8/1992 Hare
5,217,793 A * 6/1993 Yamane et al. ..... 428/212
5,236,801 A 8/1993 Hare
5,242,739 A 9/1993 Kronzer et al.
5,252,531 A 10/1993 Yasuda et al.
5,271,990 A 12/1993 Kronzer et al.
5,320,885 A 6/1994 Yamane et al.
5,334,439 A 8/1994 Kawaguchi et al.
5,350,474 A 9/1994 Yamane
5,362,703 A 11/1994 Kawasaki et al.
5,372,884 A 12/1994 Abe et al.
5,400,246 A 3/1995 Wilson et al.
5,407,724 A 4/1995 Mimura et al.
5,431,501 A 7/1995 Hale et al.
5,434,598 A 7/1995 Shimomine et al.
5,501,902 A 3/1996 Kronzer
5,521,229 A 5/1996 Lu et al.
5,614,345 A 3/1997 Gumbiowski et al.
5,620,548 A 4/1997 Hare
5,665,476 A 9/1997 Oez
5,707,925 A 1/1998 Akada et al.
5,770,268 A 6/1998 Kuo et al.
5,798,161 A 8/1998 Kita et al.
5,798,179 A 8/1998 Kronzer
5,821,028 A 10/1998 Maejima et al.
5,833,790 A 11/1998 Hare
5,861,355 A 1/1999 Olson et al.
5,905,497 A 5/1999 Vaughan et al.
5,917,730 A 6/1999 Rittie et al.
5,925,712 A 7/1999 Kronzer
5,942,335 A 8/1999 Chen et al.
5,948,586 A 9/1999 Hare
5,962,149 A 10/1999 Kronzer
5,981,045 A 11/1999 Kuwabara et al.
5,981,077 A 11/1999 Taniguchi
6,017,611 A 1/2000 Cheng et al.
6,033,739 A 3/2000 Kronzer
6,033,824 A 3/2000 Hare et al.
6,036,808 A 3/2000 Shaw-Klein et al.
6,042,914 A 3/2000 Lubar
6,054,223 A 4/2000 Tsuchiya et al.
6,066,387 A 5/2000 Ueda et al.
6,071,368 A 6/2000 Boyd et al.
6,083,656 A 7/2000 Hare et al.
6,087,061 A 7/2000 Hare et al.
6,090,520 A 7/2000 Hare et al.
6,096,475 A 8/2000 Hare et al.
6,106,982 A 8/2000 Mientus et al.
6,113,725 A 9/2000 Kronzer
6,120,888 A 9/2000 Dolsey et al.
6,139,672 A 10/2000 Sato et al.
6,177,187 B1 1/2001 Niemoller et al.
6,180,256 B1 1/2001 Sargeant
6,200,668 B1 3/2001 Kronzer
6,242,082 B1 6/2001 Mukoyoshi et al.
6,245,710 B1 6/2001 Hare
6,258,448 B1 7/2001 Hare
6,265,128 B1 7/2001 Hare et al.
6,294,307 B1 9/2001 Hare
6,331,374 B1 12/2001 Hare et al.
6,338,932 B2 1/2002 Hare et al.
6,340,550 B2 1/2002 Hare et al.
6,358,660 B1 3/2002 Agler et al.
6,383,710 B2 5/2002 Hare et al.
6,423,466 B2 7/2002 Hare
6,428,878 B1 8/2002 Kronzer
6,450,633 B1 9/2002 Kronzer
6,495,241 B2 12/2002 Sato et al.
6,497,781 B1 * 12/2002 Dalvey et al. ..... 156/234
6,506,445 B2 1/2003 Popat et al.
6,509,131 B2 1/2003 Hare et al.
6,521,327 B1 2/2003 Franke
6,531,216 B1 3/2003 Williams et al.
6,539,652 B1 4/2003 Barry
6,551,692 B1 * 4/2003 Dalvey et al. ..... 428/195.1
6,582,803 B2 6/2003 Cole et al.
6,638,604 B1 10/2003 Bamberg et al.
6,638,682 B2 10/2003 Hare et al.
6,667,093 B2 12/2003 Yuan et al.
6,677,009 B2 1/2004 Boyd et al.
6,703,086 B2 3/2004 Kronzer et al.
6,723,773 B2 4/2004 Williams et al.
6,753,050 B1 6/2004 Dalvey et al.
6,786,994 B2 9/2004 Williams et al.
6,849,312 B1 2/2005 Williams
6,869,910 B2 3/2005 Williams et al.
6,871,950 B2 3/2005 Higuma et al.
6,875,487 B1 4/2005 Williams et al.
6,878,423 B2 4/2005 Nakanishi
6,884,311 B1 4/2005 Dalvey et al.
6,916,589 B2 7/2005 Hare et al.
6,916,751 B1 7/2005 Kronzer
6,951,671 B2 10/2005 Mukherjee et al.
6,998,211 B2 2/2006 Riley et al.
7,001,649 B2 2/2006 Wagner et al.
7,008,746 B2 3/2006 Williams et al.
7,021,666 B2 4/2006 Hare
7,022,385 B1 4/2006 Nasser
7,026,024 B2 4/2006 Chang et al.
7,081,324 B1 7/2006 Hare et al.
7,160,411 B2 1/2007 Williams et al.
7,220,705 B2 5/2007 Hare
7,238,410 B2 7/2007 Kronzer
7,361,247 B2 4/2008 Kronzer
7,364,636 B2 4/2008 Kronzer
7,749,581 B2 7/2010 Nasser et al.
7,754,042 B2 * 7/2010 Dalvey et al. ..... 156/235
7,766,475 B2 8/2010 Dalvey et al.
7,771,554 B2 * 8/2010 Dalvey et al. ..... 156/235
RE41,623 E 9/2010 Schwendimann et al.
7,824,748 B2 11/2010 Dalvey et al.
RE42,541 E * 7/2011 Dalvey et al. ..... 428/32.12
8,541,071 B2 9/2013 Schwendimann et al.
2001/0051265 A1 12/2001 Williams et al.
2002/0025208 A1 2/2002 Sato et al.
2002/0048656 A1 4/2002 Sato et al.
2002/0192434 A1 12/2002 Yuan et al.
2003/0008112 A1 1/2003 Cole et al.
2003/0021962 A1 1/2003 Mukherjee et al.
2004/0100546 A1 5/2004 Horvarth
2004/0146700 A1 7/2004 Boyd et al.
2005/0048230 A1 3/2005 Dalvey et al.
2007/0172609 A1 7/2007 Williams
2007/0172610 A1 7/2007 Williams
2007/0221317 A1 9/2007 Kronzer et al.
2007/0231509 A1 10/2007 Xu et al.
2008/0149263 A1 6/2008 Dalvey et al.
2008/0302473 A1 12/2008 Dalvey et al.
2008/0305253 A1 12/2008 Dalvey et al.
2008/0305288 A1 12/2008 Dalvey et al.
2010/0323132 A1 12/2010 Dalvey et al.

(56) References Cited

U.S. PATENT DOCUMENTS

| | | | |
|---|---|---|---|
| 2011/0067806 | A1 | 3/2011 | Dalvey et al. |
| 2012/0202020 | A1 | 8/2012 | Dalvey et al. |
| 2013/0142970 | A1 | 6/2013 | Schwendimann et al. |
| 2014/0134356 | A1 | 5/2014 | Schwendimann et al. |

FOREIGN PATENT DOCUMENTS

| | | | |
|---|---|---|---|
| EP | 0881092 | A2 | 12/1998 |
| EP | 0899121 | A1 | 3/1999 |
| EP | 0933225 | A1 | 8/1999 |
| GB | 2295973 | A | 6/1996 |
| JP | 63122592 | | 5/1988 |
| JP | 1037233 | A | 2/1989 |
| JP | 7276833 | A | 10/1995 |
| JP | 8085269 | A | 4/1996 |
| WO | WO-0073570 | A1 | 12/2000 |

OTHER PUBLICATIONS

"U.S. Appl. No. 09/150,983, Non Final Office Action mailed Jan. 30, 2001", 7 pgs.
"U.S. Appl. No. 09/150,983, Non Final Office Action mailed Apr. 4, 2000", 5 pgs.
"U.S. Appl. No. 09/150,983, Non Final Office Action mailed Dec. 28, 1999", 5 pgs.
"U.S. Appl. No. 09/150,983, Notice of Allowance mailed Nov. 19, 2002", 8 pgs.
"U.S. Appl. No. 09/150,983, Response filed Feb. 16, 2000 to Non Final Office Action mailed Dec. 28, 1999", 3 pgs.
"U.S. Appl. No. 09/150,983, Response filed Jun. 20, 2000 to Non Final Office Action mailed Apr. 11, 2000", 7 pgs.
"U.S. Appl. No. 09/150,983, Response filed Aug. 7, 2002 to Non Final Office Action mailed Jan. 30, 2001", 9 pgs.
"U.S. Appl. No. 09/391,910, Restriction Requirement mailed Jun. 18, 2001", 5 pgs.
"U.S. Appl. No. 09/535,937, Non Final Office Action mailed Nov. 29, 2001", 8 pgs.
"U.S. Appl. No. 09/535,937, Notice of Allowance mailed Sep. 10, 2002", 9 pgs.
"U.S. Appl. No. 09/535,937, Preliminary Amendment filed Mar. 24, 2000", 1 pg.
"U.S. Appl. No. 09/535,937, Response filed May 28, 2002 to Non Final Office Action mailed Nov. 29, 2001", 6 pgs.
"U.S. Appl. No. 09/541,845, Final Office Action mailed Nov. 25, 2003", 4 pgs.
"U.S. Appl. No. 09/541,845, Non Final Office Action mailed Apr. 16, 2003", 4 pgs.
"U.S. Appl. No. 09/541,845, Notice of Allowance mailed May 4, 2004", 4 pgs.
"U.S. Appl. No. 09/541,845, Response filed Jan. 10, 2003 to Restriction Requirement mailed Aug. 22, 2002", 1 pg.
"U.S. Appl. No. 09/541,845, Response filed Mar. 23, 2004 to Final Office Action mailed Nov. 25, 2003", 6 pgs.
"U.S. Appl. No. 09/541,845, Response filed Jul. 15, 2003 to Non Final Office Action mailed Apr. 14, 2003", 5 pgs.
"U.S. Appl. No. 09/541,845, Restriction Requirement mailed Aug. 22, 2002", 5 pgs.
"U.S. Appl. No. 09/541,845, Supplemental Notice of Allowability mailed Jan. 26, 2005", 2 pgs.
"U.S. Appl. No. 09/541,845, Supplemental Restriction Requirement mailed Jan. 6, 2003", 5 pgs.
"U.S. Appl. No. 09/661,532, Final Office Action mailed May 20, 2003", 8 pgs.
"U.S. Appl. No. 09/661,532, Non Final Office Action mailed Mar. 1, 2002", 9 pgs.
"U.S. Appl. No. 09/661,532, Notice of Allowance mailed Feb. 12, 2004", 4 pgs.
"U.S. Appl. No. 09/661,532, Response filed Aug. 20, 2003 to Final Office Action mailed May 20, 2003", 5 pgs.
"U.S. Appl. No. 09/661,532, Response filed Aug. 30, 2002 to Non Final Office Action mailed Mar. 1, 2002", 8 pgs.
"U.S. Appl. No. 09/661,532, Response filed Dec. 23, 2002 to Restriction Requirement mailed Nov. 26, 2002", 2 pgs.
"U.S. Appl. No. 09/661,532, Restriction Requirement mailed Nov. 26, 2002", 5 pgs.
"U.S. Appl. No. 10/719,220, Non Final Office Action mailed Sep. 9, 2004", 3 pgs.
"U.S. Appl. No. 10/719,220, Preliminary Amendment filed Nov. 21, 2003", 3 pgs.
"U.S. Appl. No. 10/911,249, Examiner Interview Summary mailed Jan. 15, 2010", 4 pgs.
"U.S. Appl. No. 10/911,249, Final Office Action mailed Jun. 30, 2009", 5 pgs.
"U.S. Appl. No. 10/911,249, Final Office Action mailed Jan. 29, 2008", 6 pgs.
"U.S. Appl. No. 10/911,249, Final Office Action mailed Jul. 26, 2005", 3 pgs.
"U.S. Appl. No. 10/911,249, Final Office Action mailed Dec. 8, 2006", 3 pgs.
"U.S. Appl. No. 10/911,249, Final Office Action mailed Dec. 14, 2006", 3 pgs.
"U.S. Appl. No. 10/911,249, Non Final Office Action mailed Feb. 8, 2005", 5 pgs.
"U.S. Appl. No. 10/911,249, Non Final Office Action mailed Mar. 13, 2007", 4 pgs.
"U.S. Appl. No. 10/911,249, Non Final Office Action mailed Mar. 16, 2010", 6 pgs.
"U.S. Appl. No. 10/911,249, Non Final Office Action mailed Sep. 20, 2007", 5 pgs.
"U.S. Appl. No. 10/911,249, Notice of Allowance mailed Mar. 25, 2008", 4 pgs.
"U.S. Appl. No. 10/911,249, Notice of Allowance mailed Aug. 20, 2010", 16 pgs.
"U.S. Appl. No. 10/911,249, Preliminary Amendment filed Aug. 4, 2004", 4 pgs.
"U.S. Appl. No. 10/911,249, Response filed Jan. 5, 2009 to Final Office Action mailed Dec. 5, 2008", 10 pgs.
"U.S. Appl. No. 10/911,249, Response filed Jan. 24, 2007 to Non Final Office Action mailed Dec. 14, 2006", 8 pgs.
"U.S. Appl. No. 10/911,249, Response filed Jan. 25, 2006 to Final Office Action filed Jul. 26, 2005", 7 pgs.
"U.S. Appl. No. 10/911,249, Response filed Feb. 18, 2008 to Final Office Action filed Jan. 29, 2008", 7 pgs.
"U.S. Appl. No. 10/911,249, Response filed Mar. 11, 2009 to Final Office Action mailed Feb. 9, 2009", 13 pgs.
"U.S. Appl. No. 10/911,249, Response filed May 4, 2005 to Non Final Office Action mailed Feb. 8, 2005", 6 pgs.
"U.S. Appl. No. 10/911,249, Response filed Jun. 7, 2010 to Non Final Office Action mailed Mar. 16, 2010", 14 pgs.
"U.S. Appl. No. 10/911,249, Response filed Jul. 11, 2007 to Non Final Office Action mailed Mar. 13, 2007", 11 pgs.
"U.S. Appl. No. 10/911,249, Response filed Jul. 29, 2008 to Final Office Action mailed Jan. 29, 2008", 19 pgs.
"U.S. Appl. No. 10/911,249, Response filed Nov. 30, 2009 to Non Final Office Action mailed Sep. 21, 2009", 17 pgs.
"U.S. Appl. No. 10/911,249, Response filed Dec. 14, 2007 to Non Final Office Action mailed Sep. 20, 2007", 9 pgs.
"U.S. Appl. No. 10/911,249, Response to Notice of Non-Compliant Amendment filed Jun. 2, 2005", 5 pgs.
"U.S. Appl. No. 10/911,249, Response to Notice of Non-Compliant Amendment filed Nov. 24, 2008", 25 pgs.
"U.S. Appl. No. 11/054,717, Final Office Action mailed Mar. 29, 2010", 5 pgs.
"U.S. Appl. No. 11/054,717, Final Office Action mailed Jun. 1, 2007", 4 pgs.
"U.S. Appl. No. 11/054,717, Non Final Office Action mailed Jan. 9, 2009", 10 pgs.
"U.S. Appl. No. 11/054,717, Non Final Office Action mailed Jul. 15, 2010", 4 pgs.
"U.S. Appl. No. 11/054,717, Non Final Office Action mailed Sep. 11, 2007", 3 pgs.

(56) References Cited

OTHER PUBLICATIONS

"U.S. Appl. No. 11/054,717, Non Final Office Action mailed Oct. 23, 2006", 4 pgs.
"U.S. Appl. No. 11/054,717, Notice of Allowance mailed Nov. 3, 2010", 21 pgs.
"U.S. Appl. No. 11/054,717, Preliminary Amendment filed Feb. 9, 2005", 3 pgs.
"U.S. Appl. No. 11/054,717, Response filed May 11, 2009 to Non Final Office Action mailed Jan. 9, 2009", 12 pgs.
"U.S. Appl. No. 11/054,717, Response filed Jun. 1, 2010 to Final Office Action mailed Mar. 29, 2010", 11 pgs.
"U.S. Appl. No. 11/054,717, Response filed Aug. 1, 2007 to Final Office Action mailed Jun. 1, 2007", 6 pgs.
"U.S. Appl. No. 11/054,717, Response filed Aug. 10, 2010 to Non Final Office Action mailed Jul. 15, 2010", 9 pgs.
"U.S. Appl. No. 11/054,717, Response filed Oct. 10, 2007 to Non Final Office Action mailed Sep. 11, 2007", 5 pgs.
"U.S. Appl. No. 11/054,717, Response filed Nov. 26, 2008 to Restriction Requirement mailed Nov. 20, 2008", 9 pgs.
"U.S. Appl. No. 11/054,717, Response filed Dec. 5, 2006 to Non Final Office Action mailed Oct. 23, 2006", 9 pgs.
"U.S. Appl. No. 11/054,717, Restriction Requirement mailed Nov. 20, 2009", 5 pgs.
"U.S. Appl. No. 11/054,717, Supplemental Amendment filed Oct. 24, 2008", 8 pgs.
"U.S. Appl. No. 11/054,717, Supplemental Amendment filed Sep. 30, 2008", 10 pgs.
"U.S. Appl. No. 12/034,932, 312 Amendment filed Jul. 1, 2010", 2 pgs.
"U.S. Appl. No. 12/034,932, Examiner Interview Summary mailed Jan. 15, 2010", 4 pgs.
"U.S. Appl. No. 12/034,932, Final Office Action mailed May 7, 2010", 4 pgs.
"U.S. Appl. No. 12/034,932, Non Final Office Action mailed Sep. 10, 2009", 5 pgs.
"U.S. Appl. No. 12/034,932, Notice of Allowance mailed Jun. 9, 2010", 4 pgs.
"U.S. Appl. No. 12/034,932, Preliminary Amendment filed Aug. 18, 2008", 14 pgs.
"U.S. Appl. No. 12/034,932, PTO Response to 312 Amendment mailed Jul. 8, 2010", 2 pgs.
"U.S. Appl. No. 12/034,932, Response filed Feb. 10, 2010 to Non Final Office Action mailed Sep. 10, 2009", 16 pgs.
"U.S. Appl. No. 12/034,932, Response filed May 14, 2010 to Final Office Action mailed May 7, 2010", 7 pgs.
"U.S. Appl. No. 12/193,562, Examiner Interview Summary mailed Jan. 13, 2010", 4 pgs.
"U.S. Appl. No. 12/193,562, Final Office Action mailed Mar. 24, 2010", 5 pgs.
"U.S. Appl. No. 12/193,562, Non Final Office Action mailed Sep. 9, 2009", 5 pgs.
"U.S. Appl. No. 12/193,562, Notice of Allowance mailed Jun. 15, 2010", 8 pgs.
"U.S. Appl. No. 12/193,562, Response filed May 24, 2010 to Final Office Action mailed Mar. 24, 2010", 8 pgs.
"U.S. Appl. No. 12/193,562, Response filed Dec. 9, 2009 to Non Final Office Action mailed Sep. 9, 2009", 17 pgs.
"U.S. Appl. No. 12/193,562, Supplemental Response filed Feb. 9, 2010 to Non Final Office Action mailed Sep. 9, 2009", 9 pgs.
"U.S. Appl. No. 12/193,573, Examiner Interview Summary mailed Jan. 13, 2010", 4 pgs.
"U.S. Appl. No. 12/193,573, Examiner Interview Summary mailed May 19, 2010", 1 pg.
"U.S. Appl. No. 12/193,573, Non Final Office Action mailed Apr. 7, 2009", 11 pgs.
"U.S. Appl. No. 12/193,573, Non Final Office Action mailed Sep. 11, 2009", 5 pgs.
"U.S. Appl. No. 12/193,573, Notice of Allowance mailed May 5, 2010", 9 pgs.
"U.S. Appl. No. 12/193,573, Response filed Feb. 10, 2010 to Non Final Office Action mailed Sep. 11, 2009", 18 pgs.
"U.S. Appl. No. 12/193,573, Response filed Jun. 15, 2009 to Non Final Office Action mailed Apr. 7, 2009", 19 pgs.
"U.S. Appl. No. 12/193,578, 312 Amendment filed May 19, 2010", 2 pgs.
"U.S. Appl. No. 12/193,578, Non Final Office Action mailed Feb. 11, 2009", 12 pgs.
"U.S. Appl. No. 12/193,578, Non Final Office Action mailed Sep. 11, 2009", 5 pgs.
"U.S. Appl. No. 12/193,578, Notice of Allowance mailed Apr. 22, 2010", 7 pgs.
"U.S. Appl. No. 12/193,578, PTO Response to 312 Amendment mailed Jun. 4, 2010", 2 pgs.
"U.S. Appl. No. 12/193,578, Response filed Feb. 10, 2010 to Non Final Office Action mailed Sep. 11, 2009", 20 pgs.
"U.S. Appl. No. 12/193,578, Response filed Jun. 15, 2009 to Non-Final Office Action mailed Feb. 11, 2009", 16 pgs.
"U.S. Appl. No. 12/218,260, Examiner Interview Summary mailed Apr. 23, 2010", 3 pgs.
"U.S. Appl. No. 12/218,260, Examiner Interview Summary mailed May 24, 2010", 1 pg.
"U.S. Appl. No. 12/218,260, Examiner Interview Summary mailed Jun. 10, 2010", 3 pgs.
"U.S. Appl. No. 12/218,260, Non Final Office Action mailed Jan. 2, 2009", 11 pgs.
"U.S. Appl. No. 12/218,260, Non Final Office Action mailed Nov. 3, 2009", 3 pgs.
"U.S. Appl. No. 12/218,260, Notice of Allowance mailed Apr. 1, 2010", 9 pgs.
"U.S. Appl. No. 12/218,260, Preliminary Amendment filed Jul. 11, 2008", 9 pgs.
"U.S. Appl. No. 12/218,260, Preliminary Amendment filed Sep. 10, 2009", 10 pgs.
"U.S. Appl. No. 12/218,260, Response filed Apr. 2, 2009 to Non Final Office Action mailed Jan. 2, 2009", 7 pgs.
"U.S. Appl. No. 12/218,260, Response filed Dec. 3, 2009 to Non Final Office Action mailed Nov. 3, 2009", 12 pgs.
"U.S. Appl. No. 12/218,260, Supplemental Notice of Allowability mailed Jun. 10, 2010", 6 pgs.
"U.S. Appl. No. 12/875,445, Non Final Office Action mailed Aug. 24, 2012", 6 pgs.
"U.S. Appl. No. 12/875,445, Non Final Office Action mailed Sep. 26, 2011", 6 pgs.
"U.S. Appl. No. 12/875,445, Non Final Office Action mailed Dec. 2, 2011", 5 pgs.
"U.S. Appl. No. 12/875,445, Notice of Allowance mailed Sep. 19, 2012", 6 pgs.
"U.S. Appl. No. 12/875,445, Response filed May 18, 2012 to Non Final Office Action mailed Dec. 2, 2011", 9 pgs.
"U.S. Appl. No. 12/875,445, Response filed Aug. 13, 2012 to Final Office Action mailed Jun. 13, 2012", 10 pgs.
"U.S. Appl. No. 12/875,445, Response filed Aug. 29, 2012 to Non Final Office Action mailed Aug. 24, 2012", 9 pgs.
"U.S. Appl. No. 12/875,445, Response filed Nov. 1, 2011 to Non Final Office Action mailed Sep. 26, 2011", 12 pgs.
"U.S. Appl. No. 12/955,512, Non Final Office Action mailed Nov. 10, 2011", 7 pgs.
"U.S. Appl. No. 12/955,512, Notice of Allowance mailed Feb. 21, 2012", 6 pgs.
"U.S. Appl. No. 12/955,512, Response filed Jan. 26, 2012 to Non Final Office Action mailed Nov. 10, 2011", 13 pgs.
"U.S. Appl. No. 13/447,886, Non Final Office Action mailed Jul. 18, 2012", 5 pgs.
"U.S. Appl. No. 13/447,886, Non Final Office Action mailed Dec. 11, 2012", 4 pgs.
"U.S. Appl. No. 13/447,886, Notice of Allowance mailed Feb. 8, 2013", 5 pgs.
"U.S. Appl. No. 13/447,886, Response filed Jan. 17, 2013 to Non Final Office Action mailed Dec. 11, 2012", 7 pgs.

(56) References Cited

OTHER PUBLICATIONS

"U.S. Appl. No. 13/447,886, Response filed Nov. 19, 2012 to Non Final Office Action mailed Jul. 18, 2012", 10 pgs.
"U.S. Appl. No. 13/745,995 , Response filed Sep. 23, 2013 to Non Final Office Action mailed Jun. 21, 2013", 7 pgs.
"U.S. Appl. No. 13/745,995, Non Final Office Action mailed Jun. 21, 2013", 4 pgs.
"U.S. Appl. No. 13/745,995, Notice of Allowance mailed Oct. 21, 2013", 7 pgs.
"International Application Serial No. International Application Serial No. PCT/US99/20823, International Preliminary Examination Report mailed Sep. 19, 2000", 14 pgs.
"International Application Serial No. PCT/US99/20823, International Search Report mailed Dec. 13, 1999", 3 pgs.
"International Application Serial No. PCT/US00/24633, International Search Report mailed Nov. 30, 2000", 7 pgs.
"International Application Serial No. PCT/US99/20823, International Preliminary Examination Report mailed Sep. 19, 2000", 14 pgs.
"International Application Serial No. PCT/US99/20823, International Search Report mailed Dec. 13, 1999", 8 pgs.
"International Application Serial No. PCT/US99/20823, International Written Opinion mailed May 16, 2000", 15 pgs.
"International Application Serial No. PCT/US99/20823, Written Opinion mailed May 16, 2000", 15 pgs.

* cited by examiner

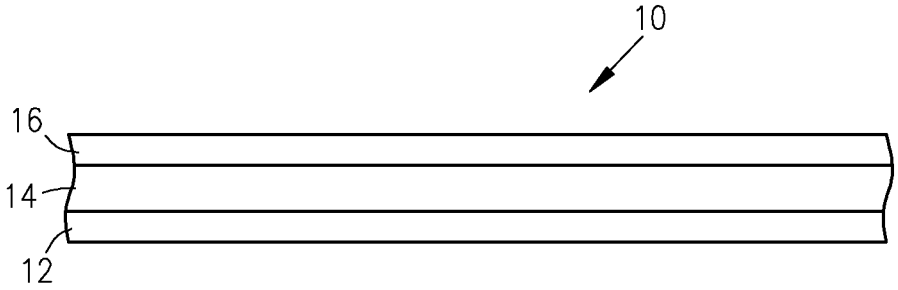
10
16
14
12

IMAGE TRANSFER SHEET

RELATED APPLICATIONS

This application is a continuation of U.S. application Ser. No. 13/447,886, filed Apr. 16, 2012, which is a continuation of U.S. application Ser. No. 12/955,512 , filed Nov. 29 , 2010 and issued on Jun. 12, 2012 as U.S. Pat. No. 8,197,918, which is a continuation of U.S. application Ser. No. 11/054,717 filed Feb. 9, 2005 and issued on Jul. 12, 2011as U.S. Pat. No. RE42,541,which is a reissue of U.S. application Ser. No. 09/150,983 filed Sep. 10, 1998 , now U.S. Pat. No. 6,551,692 , the entirety of each of the disclosures of which are explicitly incorporated by reference herein.

This application is also related to U.S. application Ser. No. 09/535,937 filed Mar. 24, 2000, now U.S. Pat. No. 6,497,781, the entirety of which is explicitly incorporated by reference herein.

BACKGROUND

Image transfer to articles made from materials such as fabric, nylon, plastics and the like has increased in popularity over the past decade due to innovations in image development. On Feb. 5, 1974, La Perre et al. were issued a United States Patent describing a transfer sheet material markable with uniform indicia and applicable to book covers. This sheet material included adhered plies of an ink-receptive printable layer and a solvent-free, heat-activatable adhesive layer. The adhesive layer was somewhat tacky prior to heat activation to facilitate positioning of a composite sheet material on a substrate which was to be bonded. The printable layer had a thickness of 10 to 500 microns and had an exposed porous surface of thermoplastic polymeric material at least 10 microns thick.

Indicia were applied to the printable layer with a conventional typewriter. A thin film of temperature-resistant, low surface energy polymer, such as polytetrafluoroethylene, was laid over the printed surface and heated with an iron. Heating caused the polymer in the printable layer to fuse thereby sealing the indicia into the printable layer.

On Sep. 23, 1980, Hare was issued U.S. Pat. No. 4,224,358, which described a kit for applying a colored emblem to a t-shirt. The kit comprised a transfer sheet which included the outline of a mirror image of a message. To utilize the kit, a user applied a colored crayon to the transfer sheet and positioned the transfer sheet on a t-shirt. A heated instrument was applied to the reverse side of the transfer sheet in order to transfer the colored message.

The Greenman et al. patent, U.S. Pat. No. 4,235,657, issuing Nov. 25, 1980, described a transfer web for a hot melt transfer of graphic patterns onto natural, synthetic fabrics. The transfer web included a flexible substrate coated with a first polymer film layer and a second polymer film layer. The first polymer film layer was made with a vinyl resin and a polyethylene wax which were blended together in a solvent or liquid solution. The first film layer served as a releasable or separable layer during heat transfer. The second polymeric film layer was an ionomer in an aqueous dispersion. An ink composition was applied to a top surface of the second film layer. Application of heat released the first film layer from the substrate while activating the adhesive property of the second film layer thereby transferring the printed pattern and a major part of the first layer along with the second film layer onto the work piece. The second film layer bonded the printed pattern to the work piece while serving as a protective layer for the pattern.

The Sanders et al. patent, U.S. Pat. No. 4,399,209, issuing Aug. 16, 1983, describes an imaging system in which images were formed by exposing a photosensitive encapsulate to actinic radiation and rupturing the capsules in the presence of a developer so that there was a pattern reaction of a chromogenic material present in the encapsulate or co-deposited on a support with the encapsulate and the developer which yielded an image.

The Goffi patent, U.S. Pat. No. 4,880,678, issuing Nov. 14, 1989, describes a dry transfer sheet that comprises a colored film adhering to a backing sheet with an interposition of a layer of release varnish. The colored film included 30% to 40% pigment, 1% to 4% of cycloaliphatic epoxy resin, from 15% to 35% of vinyl copolymer and from 1% to 4% of polyethylene wax. This particular printing process was described as being suitable for transferring an image to a panel of wood.

The Kronzer et al. patent, U.S. Pat. No. 5,271,990, issuing Dec. 21, 1993, describes an image-receptive heat transfer paper that included a flexible paper based web base sheet and an image-receptive melt transfer film that overlaid a top surface of the base sheet. The image-receptive melt transfer film was comprised of a thermoplastic polymer melting at a temperature within a range of 65 degrees C. to 180 degrees C.

The Higashiyami et al. patent, U.S. Pat. No. 5,019,475, issuing May 28, 1991, describes a recording medium that included a base sheet, a thermoplastic resin layer formed on at least one side of the base sheet and a color developer layer formed on a thermoplastic resin layer and capable of color development by reaction with a dye precursor.

BRIEF DESCRIPTION OF THE DRAWINGS

The drawing illustrates generally, by way of example, but not by way of limitation, one embodiment discussed in the present document.

FIG. 1 illustrates a cross-sectional view of one embodiment of an image transfer sheet of the present invention.

SUMMARY

One embodiment of the present invention includes a method for transferring an image from one substrate to another. The method comprises providing an image transfer article, such as a sheet, which is comprised of a substrate layer, a release layer and an image-imparting layer that comprises a polymer component such as a low density polyethylene (LDPE) or Ethylene Acrylic Acid (EAA) or Ethylene Vinyl Acetate (EVA) or Methane Acrylic Ethylene Acrylic (MAEA) or mixtures of these materials, each having a melt index within a range of about 20 to about 1,200 degrees C.-g/10 minute (SI). An image is imparted to the polymer component of the image imparting layer through an image imparting medium such as ink or toner.

In one embodiment, an image-receiving substrate is also provided. The image-receiving substrate is contacted to the image transfer sheet and is specifically contacted to the polymer component of the image imparting layer. Heat is applied to the substrate layer of the image transfer sheet and is transferred to the polymer component of the image imparting layer so that the polymer, such as the LDPE, EAA, EVA, or MAEA encapsulates the image-imparting medium and transfers the encapsulates to the image-receiving substrate thereby forming a mirror image on the image-receiving substrate.

One other embodiment of the present invention includes an image transfer sheet that comprises a substrate layer, a release layer and an image imparting layer that comprises a polymeric layer such as a low density polyethylene layer, an EAA layer, an EVA layer, or an MAEA layer. An image receptive layer is a top polymer layer.

With one additional embodiment, an image transfer sheet of the present invention comprises an image imparting layer but is free from an image receptive layer such as an ink receptive layer. Image indicia are imparted, with this embodiment, using techniques such as color copy, laser techniques, toner or by thermo transfer from ribbon wax or from resin.

The LDPE polymer of the image imparting layer melts at a point within a range of about 43 degrees C. to about 300 degrees C. The LDPE has a melt index (MI) of about 60 to about 1,200 SI-g/10 minute.

The EAA has an acrylic acid concentration ranging from about 5% to about 25% by weight and has a MI of about 20 to about 1300 g/10 minutes. A preferred EAA embodiment has an acrylic acid concentration of 7% to 20% by weight and an MI range of 20 to 700.

The EVA has a MI within a range of about 20 to about 2300. The EVA has a vinyl acetate concentration ranging from about 10% to about 30% by weight.

The present invention further includes a kit for image transfer. The kit comprises an image transfer sheet that is comprised of a substrate layer, a release layer and an image imparting layer made of a polymer such as LDPE, EAA, EVA, or MAEA or mixtures of these polymers that melt at a temperature within a range of about 100 degrees C. to about 700 degrees C. The LDPE has a melt index of about 60 to about 1,200 (SI)-g/minute. The kit can also include a device for imparting an image-imparting medium to the polymer component of the image imparting layer of the image transfer sheet. One kit embodiment additionally includes an image-receiving substrate, such as an ink receptive layer, that is an element of the image transfer sheet.

DETAILED DESCRIPTION

In one embodiment of the present invention, an image transfer sheet, illustrated generally at 10 in FIG. 1, is comprised of a substrate layer 12, a release layer 14 comprising a silicone coating and a peel layer 16 that together have a thickness of about 3 to 8 mils. The peel layer 16 can also be referred to as an image imparting layer 16, and can comprise a polymer component selected from one or more of a low density polyethylene (LDPE), ethylene acrylic acid (EAA), ethylene vinyl acetate (EVA), or methane acrylic ethylene acetate (M/EAA), having a melt index of about 20 to about 1200 (SI) g/10 minute and a polymer thickness of about 0.7 to about 2.3 mils of polymer or (20 g/m$^2$to 50 g/m$^2$with a melting point range of 40 degrees C. to 450 degrees C.). The release layer 14 is sandwiched between the substrate layer 12 and the peel layer 16 comprising a polymeric material such as LDPE, EAA, EVA or M/EAA.

Another embodiment of the present invention also includes a method for transferring an image from one substrate to another. The method comprises a step of providing or obtaining an image transfer sheet 10 that is comprised of a substrate or base layer 12, such as box paper with a base weight of 75 g/m$^2$ to 162 g/m$^2$, a release layer 14, comprising a silicone coating, and a peel layer 16 that includes one or more of the polymers LDPE, EAA, EVA, or M/EAA at a thickness of about 1.5 mils and having a melt index, MI, within a range of 60 degrees C. to 1300 degrees C. Next, an image is imparted to the polymer component of the peel layer 16 utilizing a top coating image-imparting material such as ink or toner. The ink or toner may be applied utilizing any conventional method such as an ink jet printer or an ink pen or color copy or a laser printer. The ink may be comprised of any conventional ink formulation. An ink jet coating is preferred.

The image transfer sheet 10 is, in one embodiment, applied to a second substrate, also called the image receiving substrate, so that the polymeric component of the peel layer 16 contacts the second substrate. The second substrate may be comprised of materials such as cloth, paper and other flexible or inflexible materials. Once the image transfer sheet 10 contacts the second substrate, a source of heat, such as an iron or other heat source, is applied to the image transfer sheet 10 and heat is transferred through the substrate 12 and the release layer 14 to the peel layer 16. The peel layer 16 transfers the image to the second substrate. The application of heat to the transfer sheet 10 results in ink or other image-imparting media within the polymeric component of the peel layer being changed in form to particles encapsulated by the polymeric substrate such as the LDPE, EAA, EVA or M/EAA immediately proximal to the ink or toner. The encapsulated ink particles or encapsulated toner particles are then transferred to the second substrate in a mirror image to the ink image or toner image on the polymeric component of the peel layer while the portion of the polymer of the peel layer 16 not contacting the ink or toner and encapsulating the ink or toner is retained on the image transfer sheet 10.

When image imparting media and techniques such as color copy, laser techniques, toner or thermo transfer from ribbon wax or resin are employed, it is not necessary to apply an image receiving layer to the image transfer sheet.

As used herein, the term "melt index" refers to the value obtained by performing ASTM D-1238 under conditions of temperature, applied load, timing interval and other operative variables which are specified therein for the particular polymer being tested.

It is believed that the addition of ink or toner to the image imparting layer, specifically, to the LDPE or to the EAA, EVA, or E/MAA polymeric component, locally lowers the melting point of the polymeric component material such as LDPE, EAA, EVA, or E/MAA which either contacts the ink or toner or is immediately adjacent to the ink or toner. Thus, an application of heat to the polymeric component of the peel layer 16 results in a change in viscosity of the low density polyethylene or other polymeric material contacted by the ink or toner and immediately adjacent to the ink or toner as compared to the surrounding polymeric media. It is believed that the polymeric component such as LDPE, EAA, EVA or E/MAA polyethylene locally melts with the ink or toner. However, as heat is removed and the area cools, the polymeric component solidifies and encapsulates the ink or toner. The solidification-encapsulation occurs substantially concurrently with transfer of the ink-LDPE or ink-EAA, ink-EVA or ink-E/MAA or other polymer mixture to the receiving substrate.

Because the polymeric component of the peel layer 16 generally has a high melting point, the application of heat, such as from an iron, does not result in melting of this layer or in a significant change in viscosity of the overall peel layer 16. The change in viscosity is confined to the polymeric component that actually contacts the ink or toner or is immediately adjacent to the ink or toner. As a consequence, a mixture of the polymeric component and ink or toner is transferred to the second substrate sheet as an encapsulate whereby the polymeric component encapsulates the ink or toner. It is believed that the image transfer sheet of the present invention is uniquely capable of both cold peel and hot peel with a very good performance for both types of peels.

One polymeric component, the low density polyethylene ethylene-acrylic acid (EAA) polymeric component, is formed as a product of the co-polymerization of ethylene and acrylic acid forming a polymer with carboxyl groups. The low density EAA polymer is more amorphous than low density polyethylene which causes the EAA to decrease in melting point as compared to LDPE. The carboxyl groups of the acrylic acid group of EAA also provide chemical functional groups for hydrogen bonding.

In one preferred EAA polymer embodiment, acrylic acids are present in a concentration of 5% to 25% by weight of the EAA formulation. The EAA has a melt index ranging from 20 to 1200. The most preferred EAA formulation has an acrylic acid concentration of 10% to 20% by weight. This EAA embodiment has a MI of 60 to 500.

Other polymeric materials that may be used include an ethylene melt with acrylic acid copolymer resin and with a melt flow index ranging from 20 to 1,500 DS/minute and preferably having a melt flow index of 50 to 100 DS/minute. This ethylene-acrylic acid polymer melt, known as E/MAA, along with ethylene acrylic acid, EAA, or ethylene vinyl acetate (EVA) with acetate percentages ranging from 4% to 30% and preferably 11% to 20% may be used as the polymer in the peel layer 16. One other preferred E/MAA embodiment has a MI of 60 to 600. One preferred embodiment of E/MAA and EAA includes an acid content within a concentration range of 4% to 25%.

One other polymeric material that may be used is EVA with Vinyl Acetate contents. This polymer has a MI of 100 to 2300. The vinyl acetate contents range from approximately 10% to 30% by weight. In one preferred embodiment, the EVA includes vinyl acetate contents of 10% to 28%, with a melt index within a range of 10 to 600. In one other preferred embodiment, the EVA has an MI within a range of 20 to 600. It is also contemplated that a polyethylene copolymer dispersion may be suitable for use in this layer.

The melt flow indices of these polymer components range from 100 DS/minute to 2,500 DS/minute with a preferable range of 20 to 700 DS/minute. Each of these polymeric components, in addition to a Surlyninoma resin are usable with or without additives, such as slip additives, UV absorbents, optical brighteners, pigments, antistatics and other additives conventionally added to this type of polymer. All of these polymeric components have softening points within a range of 40 degrees C. to 300 degrees C.

The sheet and method of the present invention accomplish with a simple elegance what other methods and transfer sheets have attempted to accomplish with a great deal of complexity. The sheet and method of the present invention do not require complicated coloring or image-generating systems such as preformed encapsulates. The image transfer sheet and method, furthermore, do not require complicated layer interaction in order to transfer a stable image to an image-receiving substrate. The image transfer sheet of the present invention merely requires a user to impart an image to the polymeric component of the peel or image imparting layer with a material such as ink or toner. In one embodiment, once the image is transferred, the user contacts the peel layer 16 to the second or receiving substrate and applies a source of heat such as an iron. The capacity of the polymeric component of the peel layer to encapsulate an image-imparting media such as ink or toner renders this image transfer sheet exceedingly versatile.

The substrate layer 12 of the image transfer sheet 10 is preferably made of paper but may be made of any flexible or inflexible material ranging from fabric to polypropylene. Specific substrate materials include polyester film, polypropylene, or other film having a matte or glossy finish. In one embodiment, the substrate is a base paper having a weight-to-surface area within a range of 60 g/m$^2$ to 245 g/m$^2$ and preferably a range of 80 g/m$^2$ to 145 g/m$^2$. The substrate has a thickness that falls within a range of 2.2 to 12.0 mils and a preferred thickness of 3 to 8.0 mils, as measured in a Tappi 411 test procedure.

The substrate layer may be coated with clay on one side or both sides. The substrate layer may be resin coated or may be free of coating if the substrate is smooth enough. In one embodiment, overlying the substrate is a silicone coating. The silicone coating has a range of thickness of 0.1 to 2.0 mils with a preferred thickness range of 0.1 to 0.7 mils. The silicone coating has a release in g/inch within a range of 50 to 1100 and a preferred release of 65 to 800 g/inch as measured by a Tappi-410 method. Other release coatings such as fluorocarbon, urethane, or acrylic base polymer may be used.

The silicone-coated layer acts as a release-enhancing layer. It is believed that when heat is applied to the image transfer sheet, thereby encapsulating the image-imparting media such as ink or toner with low density polyethylene, Ethylene Acrylic Acid (EAA), Ethylene Vinyl Acetate (EVA) or Methane Acrylic Ethylene Acrylic (MAEA), or mixtures of these materials, local changes in temperature and fluidity of the low density polyethylene or other polymeric material occurs. These local changes are transmitted into the silicone-coated release layer and result in local, preferential release of the low density polyethylene encapsulates.

This local release facilitates transfer of a "clean" image from the image transfer sheet to the final substrate. By "clean" image is meant an image with a smooth definition.

The silicone-coated release layer is an optional layer that may be eliminated if the image-receiving surface 17 of the peel layer 16 is sufficiently smooth to receive the image. In instances where a silicone-coated release layer is employed, a silicone-coated paper with silicone deposited at 0.32 to 2.43 g/m$^2$ is employed. The silicone-coated paper preferably has a release value between 50 g/in. and 700 g/in. The paper may be coated on a backside for curl control or other function, printability or heat stabilities.

A top surface of the silicone may be treated with a corona treatment or chemical treatment prior to application of the polymeric component or on top of the polymer in order to provide better adhesion or to improve washability of the image transferred.

One desirable quality of the polymeric component, LDPE, EVA, EAA or M/EAA, is that it has a capacity to coat any fibers or other types of discontinuities on the image-receiving substrate and to solidify about these fibers or discontinuities. This coating and solidification on fibers or any other type of discontinuity in the receiving substrate aids in imparting a permanency to the final, transferred image. Because the image-generated media, such as ink or toner, is actually encapsulated in the low density polyethylene or other polymeric component material, the image transferred along with the LDPE, EVA, EAA or M/EAA, is a permanent image that cannot be washed away or removed with conventional physical or chemical perturbations such as machine washing. The polymeric materials LDPE, EVA, EAA, or M/EAA are relatively inert to chemical perturbations. In one embodiment, the LDPE, EVA, EAA, or M/EAA is applied to either the substrate or the release layer 14 in a thickness within a range of 0.5 mils to 2.8 mils or 10 g/m$^2$ to 55 g/m$^2$ and preferably 22 g/m$^2$ to 48 g/m$^2$.

Overlying the polymeric component containing peel layer 16 can be a prime layer GAT with polyethylene dispersion or an EAA or EVA dispersion. This layer can have a high melting index within a range of 200 to 2,000. The EAA emulsion dispersion has an MI of 200 to 2000 and has an acrylic acid concentration of 7% to 25% by weight. The EVA dispersion has an MI of 200 to 2500 and an acetate or other acrylic polymer concentration of 7% to 33% by weight.

A fifth layer can be an ink jet coating receptor layer having a thickness of 3 g/m$^2$ to 30 g/m$^2$. Overlying the ink jet coating receptor layer can be an ink jet top coating layer having a thickness of 4 g/m$^2$ to 30 g/m$^2$. In one embodiment, the ink jet coating receptor layer and ink jet top coating layer are combined to create a single layer having a heavier coat weight. This layer is not required when image imparting techniques such as color copy, laser, toner, or thermo transfer from ribbon wax or resin are employed.

In one embodiment, the image transfer sheet of the present invention is made by applying a low density polyethylene, or a low density polyethylene ethylene acrylic acid or an ethylene vinyl acetate (10% to 28%) of vinyl acetate to the substrate utilizing a process such as extrusion, hot melt, slot die, or a "roll on" process or other similar process.

The low density polyethylene preferably has a melt index within a range of 20 to 1,200 g/10 minutes and most preferably a melt index of 100 to 700-g/minute. An acceptable melt flow rate measured at 125 degrees C. and 325 grams falls within a range of 7 to 30 g/10 min., with a preferred range of 8 to 20 g/10 min., as measured by ASTM Test Method D-1238. An Equivalent Melt Index, EMI, which is equal to 66.8 times (Melt Flow Rate at 125 degrees C., 325 grams) 0.83, may acceptably range from 30 to 2000 g/10 min., and preferably ranges from 200 to 800 g/10 min. The Melting Point, Tm, ranges from 43 degrees C. to 250 degrees C. with a preferred range of 65 degrees C. to 150 degrees C. as measured in ASTM Test Method D-3417. The Vicat Softening Point of the LDPE ranges from 43 degrees C. to 150 degrees C. as measured by ASTM Test Method D-1525.

The ethylene vinyl acetate (EVA) has a melt index of 200 to 2500 dg/minute with a preferred index range of 200 to 1200 dg/min. The Ring and Ball Softening Point ranges from 67 degrees C. to 200 degrees C., with a preferred range of 76 degrees C. to 150 degrees C. The percent vinyl acetate in the EVA is within a range of 5% to 33% and preferably within a range of 10% to 33%. The metoacrylic acid or ethylene acrylic acid also known as NucrylTM has a concentration of about 4% to 20% acrylic acid and a melt index within a range of 50 to 1,300-g/minute. The preferable range is 200 to 600-g/minute.

The EAA/EMAA has a Melt Index of 20 to 1300 dg/min., with a preferred range of 60 to 700 dg/min., as measured in ASTM Test Method D-1238. The Vicat Softening Point ranges from 43 degrees C. to 225 degrees C., with a preferred range of 43 degrees C. to 150 degrees C., as measured by ASTM Test 43 degrees C. to 150 degrees C. The EAA/EMAA has a percent acrylic acid concentration within a range of 5% to 25%, with a preferred range of 7% to 22% by weight. The Melt Flow Rate ranges from 7 to 90 g/10 min., with a preferred range of 7 to 65 g/10 min., as measured by ASTM test method D-1238.

Twenty-eight g/m$^2$ to 50 g/m$^2$ can be applied to a substrate. The application thickness of one of the LDPE, EAA, EVA or Nucryl™ is 1 to 2 mils in thickness. The most preferred range of thickness of 1.0 to 2.2 mils.

In one embodiment, the polymeric components of LDPE, EAA, EVA or Nucryl™ is applied to a silicone-release coated paper. The silicone-release coating is applied to paper or film to basis WT 80 g/m$^2$ an application quantity of 80 g/m$^2$ to 200 g/m$^2$ and preferably at a rate of 95 g/m$^2$ to 170 g/m$^2$.

Application of the polymeric component to the substrate, such as release coated paper, may be by extrusion, roll coater, any coating process, slot-die or hot melt extrusion. Other acceptable methods of application include an air knife or rod blade application. The polymeric component may be prime coated with a corona treatment or chemical treatment with acrylic acid emulsion having a melt index of 300 to 2,000-g/min., or an EVA emulsion, chemical primer or corona treatment or may be eliminated if chemical treatment for adhesion was applied. A top coat may be applied over the polymeric component. The final application is an ink jet coating of two or three passes to deposit 4 g/m$^2$ to 30 g/m$^2$ depending on particular printing applications.

One embodiment of the image transfer sheet is described in Table 1 with respect to layer identity, interlayer relationship and rate of application of each layer.

TABLE 1

| Layer Type | Applications (in g/m$^2$, unless otherwise indicated) |
|---|---|
| Base paper | 70 to 160 (layer barrier coating 3 to 10 applied on one or both sides of the base paper) |
| Silicone coating (or other release coating) | 0.4 to 2 lbs/3000 SF |
| Corona treatment (may or may not be necessary) | |
| Film or peel layer | 20 to 50 |
| Corona treatment (or other chemical treatment) | 1 to 5 |
| Ink jet coating | 4 to 35 (the ink jet coating could be applied in one, two, three or additional passes) |

The film layer may be applied as a cold peel or as a hot peel.

Presented herein is an example of one preferred embodiment of the image transfer sheet of the present invention. This example is presented to illustrate particular layers and particular specification for the layers and is not intended to limit the scope of the present invention.

EXAMPLE

In one embodiment, the image transfer sheet included a first substrate layer of base paper having a basis weight of 65 g/m$^2$ to 145 g/m$^2$ and preferably falling within a range of 97 g/m$^2$ to 138 g/m$^2$. While paper is described, it is contemplated that materials such as polyester film, polypropylene or polyethylene or other film of 142 to 1,000 gauge matte or glossy finish may be employed. In instances where paper is used, the paper may be clay coated on one side or both sides, or polymer coated.

Overlaying the base substrate paper layer was a release layer comprising silicone. Other acceptable release coatings include fluorocarbon or other acrylic, urethane release coatings and so on. The release layer had a release value ranging from 50 g/in. to 2,000 g/in., and preferably a range of 80 g/in. to 500 g/in. The release layer may be omitted if the base paper has a surface of sufficient smoothness.

A third layer, which is a peel layer of the image transfer sheet, includes a low density polyethylene or other polymer polyethylene applied at a thickness of 0.5 mils to 2.8 mils or 10 g/m$^2$ to 55 g/m$^2$ and preferably 22 g/m$^2$ to 48 g/m$^2$. Other acceptable materials for use in the third layer include acrylic acid of 5% to 22% ethylene vinyl acetate, 10% to 28% (EVA) with a melt index ranging from 30 to 2,000. In one preferred embodiment, the melt index was 60 to 500. In addition to the materials mentioned, the third layer may also be comprised of a polyethylene copolymer dispersion.

The LDPE or EVA or polyethylene copolymer dispersion is primed with GAT with a high melt index ranging from 200 to 2,000. A preferred range is 200 to 2,000. It is contemplated that this primer layer is optional.

A fifth layer is a first layer of ink jet coating receptor laid down in a concentration of 3 $g/m^2$ to 30 $g/m^2$.

A sixth layer which is a third ink jet top coating is laid down at a concentration of 4 $g/m^2$ to 15 $g/m^2$. It is possible that the ink jet top coating could be laid down in a single pass in order to make a single layer with a heavier coat weight.

The above Detailed Description includes references to the accompanying drawing, which forms a part of the Detailed Description. The drawing shows, by way of illustration, a specific embodiment in which the present image transfer sheets, method and kits can be practiced.

The above description is intended to be illustrative, and not restrictive. For example, the above-described embodiments and examples can be used in combination with each other. Other embodiments can be used, such as by one of ordinary skill in the art upon reviewing the above description. Also, in the above Detailed Description, various features can be grouped together to streamline the disclosure. This should not be interpreted as intending that an unclaimed disclosed feature is essential to any claim. Rather, inventive subject matter can lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

In the appended claims, the terms "including" and "in which" are used as the plain-English equivalents of the respective terms "comprising" and "wherein." Also, in the following claims, the terms "including" and "comprising" are open-ended, that is, an assembly, assembly, device, article, kit, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The Abstract is provided to comply with 37 C.F.R. §1.72 (b), to allow the reader to quickly ascertain the nature of the technical disclosure. It is submitted with the understanding that it will not be used to interpret or limit the scope or meaning of the claims.

What is claimed is:

1. An image transfer article, comprising:

a removable substrate, the substrate including a first and a second substrate surface, the first substrate surface abutting a release-enhancing coating; and a peel member overlaying, and peelable from, the release-enhancing coating, the peel member including a polymer component portion configured to carry image indicia to be transferred, the polymer component portion having a melting temperature of from about 43° C. to about 300° C., the polymer component portion including ethylene acrylic acid having an acrylic acid concentration within a range of 10% to 20% by weight or having a melt index within a range of 60 to 500 g/ 10 min;

wherein the removable substrate and the release-enhancing coating are configured to transfer external heat, when applied to the second substrate surface, to the peel member sufficient to encapsulate the image indicia on an image-receiving substrate during an image transfer process.

2. The image transfer article of claim 1, wherein a surface of the release-enhancing coating abutting the peel member is one or both of corona treated or chemically treated prior to being overlaid with the peel member.

3. The image transfer article of claim 1, wherein the release-enhancing coating is deposited within a range from about 0.32 grams per square meter to about 2.43 grams per square meter, thereby allowing sufficient heat to reach the peel member for encapsulating the image indicia on the image-receiving substrate.

4. The image transfer article of claim 3, wherein the release-enhancing coating includes silicone.

5. The image transfer article of claim 1, wherein release-enhancing coating has a thickness ranging from about 0.1 mils to about 2 mils, thereby allowing sufficient heat to reach the peel member for encapsulating the image indicia on the image-receiving substrate.

6. The image transfer article of claim 1, wherein the polymer component portion has a thickness ranging from about 0.5 mils to about 2.8 mils and is configured to receive image-imparting media, forming the image indicia, from a copying or printing process.

7. The image transfer article of claim 1, wherein the polymer component portion includes at least one of low density polyethylene, ethylene vinyl acetate, or a copolymer of ethylene and acrylic acid.

8. The image transfer article of claim 1, wherein the polymer component portion is configured to encapsulate image-imparting media, of the image indicia, when heat is transferred through the peel member.

9. The image transfer article of claim 1, further comprising an image-receptive member overlaying the peel member and configured to receive image-imparting media, forming the image indicia, from a copying or printing process.

10. A kit comprising:

the image transfer article of claim 1; and instructions for using the image transfer article.

11. The kit of claim 10, further comprising an image-receiving substrate configured to receive and retain image indicia transferred from the image transfer article.

12. The kit of claim 11, wherein the image-receiving substrate is a light-colored fabric.

13. An image transfer article, comprising:

a removable substrate including at least one of a base paper or a film;

a peel member including a polymer component, the polymer component including a portion configured to carry image indicia to be transferred, the polymer component having a melting temperature of from about 43° C. to about 300° C., the polymer component including ethylene acrylic acid having an acrylic acid concentration within a range of 10% to 20% by weight or having a melt index within a range of 60 to 500 g/ 10 min; and a release-enhancing coating positioned such that a first coating surface is abutting the removable substrate and a second coating surface is abutting the peel member, the peel member being removable from the release-enhancing coating when the peel member is in a heated state and when the peel member is in a cooled or ambient state, wherein the removable substrate and the release-enhancing coating are configured to transfer external heat, when applied to a surface of the removable substrate, to the peel member sufficient to encapsulate the image indicia on an image-receiving substrate during an image transfer process.

14. The image transfer article of claim 13, further comprising an image-receptive member overlaying the peel member and configured to receive image-imparting media, forming the image indicia, from a copying or printing process.

15. The image transfer article of claim 13, wherein the polymer component is configured to receiving image-imparting media, forming the image indicia, from a copying or printing process.

16. The image transfer article of claim 13, wherein the removable substrate includes a polyester film or a polypropylene film.

17. A method for transferring image indicia, the method comprising:

obtaining an image transfer article including a removable substrate, a release-enhancing coating, and a peel member, the peel member having a polymer component configured to carry image indicia and be removable from the release-enhancing coating, the polymer component having a melting temperature of from about 43° C. to about 300° C., the polymer component including ethylene acrylic acid having an acrylic acid concentration within a range of 10% to 20% by weight or having a melt index within a range of 60 to 500 g/ 10 min;

imparting image indicia to the polymer component;

obtaining an image-receiving substrate; and transferring the imparted image indicia to the image-receiving substrate, including contacting the peel member to the image-receiving substrate and applying heat to an outwardly-facing surface of the removable substrate so that the peel member encapsulates the image indicia on the image-receiving substrate.

18. The method of claim 17, wherein imparting the image indicia includes using at least one of toner or ink.

19. The method of claim 17, wherein applying heat to the removable substrate includes using a temperature within a range of about 43 degrees C. to about 300 degrees C.

20. The method of claim 17, wherein transferring the image indicia to the image-receiving substrate includes forming a mirror on the image-receiving substrate.

* * * * *

UNITED STATES PATENT AND TRADEMARK OFFICE

CERTIFICATE OF CORRECTION

PATENT NO. : 8,826,902 B2
APPLICATION NO. : 13/893748
DATED : September 9, 2014
INVENTOR(S) : Schwendimann et al.

It is certified that error appears in the above-identified patent and that said Letters Patent is hereby corrected as shown below:

On Title page 3, in column 1, References cited under "Other Publications", line 3, delete "4" and insert --11--, therefor On Title page 3, in column 2, References cited under "Other Publications", line 41, delete "25" and insert --26--, therefor In the Claims In column 12, line 17, in Claim 20, after "mirror", insert --image--, therefor Signed and Sealed this
Twenty-second Day of September, 2015

Michelle K. Lee

Michelle K. Lee
*Director of the United States Patent and Trademark Office*